US008186115B2

(12) United States Patent
Harig et al.

(10) Patent No.: US 8,186,115 B2
(45) Date of Patent: May 29, 2012

(54) MODULAR PANEL ASSEMBLIES FOR BUILDING FOUNDATIONS

(76) Inventors: Christopher W. Harig, Ashland, PA (US); Walter B. Bradley, Schuylkill Haven, PA (US)

( * ) Notice: Subject to any disclaimer, the term of this patent is extended or adjusted under 35 U.S.C. 154(b) by 809 days.

(21) Appl. No.: 11/804,621

(22) Filed: May 18, 2007

(65) Prior Publication Data

US 2007/0266651 A1 Nov. 22, 2007

Related U.S. Application Data

(60) Provisional application No. 60/801,568, filed on May 18, 2006, provisional application No. 60/904,012, filed on Feb. 28, 2007.

(51) Int. Cl.
*E04B 1/00* (2006.01)

(52) U.S. Cl. ..... 52/284; 52/126.6; 52/106

(58) Field of Classification Search ..... 52/106, 52/107, 289, 792.1, 126.5–126.6, 284, 285.2, 52/742.14, 292, 182, 584.1
See application file for complete search history.

(56) References Cited

U.S. PATENT DOCUMENTS

| | | | | |
|---|---|---|---|---|
| 3,208,410 | A * | 9/1965 | Hayes et al. | 109/1 S |
| 3,236,012 | A * | 2/1966 | Laven | 52/184 |
| 4,100,705 | A * | 7/1978 | Diana | 52/82 |
| 4,274,242 | A * | 6/1981 | Linton et al. | 52/745.12 |
| 4,332,116 | A * | 6/1982 | Buchanan | 52/82 |
| 4,599,835 | A * | 7/1986 | Rinke | 52/184 |
| 4,876,833 | A * | 10/1989 | Gefroh et al. | 52/107 |
| 5,287,675 | A * | 2/1994 | McGee | 52/770 |
| 5,487,241 | A * | 1/1996 | Gorrell et al. | 52/79.1 |
| 5,555,698 | A * | 9/1996 | Mandish | 52/745.17 |
| 5,564,235 | A | 10/1996 | Butler | 52/126.6 |
| 5,830,378 | A | 11/1998 | Butler | 249/18 |
| 6,076,320 | A | 6/2000 | Butler | 52/294 |
| 6,120,723 | A | 9/2000 | Butler | 64/333 |
| 6,205,725 | B1 * | 3/2001 | Butler | 52/292 |
| 6,367,764 | B1 | 4/2002 | Butler | 249/3 |
| 6,415,557 | B1 * | 7/2002 | McCalley | 52/79.1 |
| 6,415,558 | B1 * | 7/2002 | Cherry | 52/79.1 |
| 6,484,460 | B2 * | 11/2002 | VanHaitsma | 52/293.1 |
| 6,550,213 | B1 | 4/2003 | Butler | 52/741.15 |
| 6,959,521 | B1 * | 11/2005 | Brooks | 52/745.05 |
| 7,246,779 | B2 * | 7/2007 | Doyle | 248/188.8 |
| 7,318,300 | B1 * | 1/2008 | Seavy | 52/106 |
| 2003/0066249 | A1 * | 4/2003 | Walsh | 52/79.1 |

* cited by examiner

*Primary Examiner* — Brian Glessner
*Assistant Examiner* — Adam Barlow
(74) *Attorney, Agent, or Firm* — Drinker Biddle & Reath LLP

(57) ABSTRACT

A perimeter foundation wall is constructed from a plurality of modular wall panels. The wall panels include a generally planar exterior wall surface, a side flange on both vertically extending sides of the panel, a top cap, and a base pan. The wall may also include vertical reinforcing studs and brackets on an inner surface of the wall panels. The wall may also have leveling assemblies including threaded rods passing through the base pan.

3 Claims, 9 Drawing Sheets

MODULAR PANEL ASSEMBLIES FOR BUILDING FOUNDATIONS

RELATED APPLICATIONS

This application claims priority of provisional applications No. 60/801,568 filed May 18, 2006 and Ser. No. 60/904,012 filed Feb. 28, 2007.

FIELD OF THE INVENTION

The present invention relates generally to modular construction, and more particularly to construction of foundation walls from modular wall panels.

BACKGROUND OF THE INVENTION

Building structures are often built upon perimeter wall foundations. Typical perimeter wall foundations have been formed from poured or modular concrete or built up by grouted blocks placed atop a concrete footing (or footer). The perimeter foundation walls, and any cross beams bridging across the walls, support the first floor and higher load bearing walls of the structure.

Structures such as manufactured and modular homes may be installed on interior piers as the primary foundation support rather than using the perimeter wall as the primary support. Even when using interior pier support, however, it often required by building code to provide some type of perimeter wall to reduce shear loads, seismic vibration effects and wind uplift, and to prevent flooding and pest invasion under the foundation. While a perimeter foundation in conjunction with these interior pier supports could be constructed as traditionally done with concrete or block before the building structure is lowered into position, the difficulties and expense of precise wall placement and leveling for this type of perimeter wall has led to the use of steel panels that can be hung from the perimeter floor boards of a manufactured or modular home, and then anchored at the bottom edge in a concrete-filled trench that serves as a footer for the foundation wall.

Panel assemblies for this type of steel panel perimeter foundation are known, such as the AnchorPanel® assemblies by Fast Track Foundation Systems. These are corrugated steel panels that can be cut to length and installed with lag screws hanging under the perimeter floor boards of a pier-supported structure. The corrugated shape provides stiffening against bending under vertical and side loads. The panels have the bottom 5 or 6 inches cut along the outfacing corrugation channel and bent inward at 90 degrees to form an anchorage flange that will be encapsulated in the concrete footer. While such steel panel foundations are easier to install than concrete or grouted block, the corrugated shape requires some external facing if it is to appear flat in areas exposed above ground or to be used to attach decorative surface finishing materials to make an attractive facade.

There is a need for more efficient and versatile wall panel assemblies for foundation walls, including panels with flat exterior wall surfaces, better leveling devices, more robust bottom anchorage for encapsulation in concrete footers, provisions for cross wall beams, provisions for attached steel frame stairways, and more variations of curved panels for aesthetics.

Many of these objectives can be attained by using wall panel structures similar to those used in the construction of in-ground swimming pools, made from steel which can be galvanized or otherwise weather coated, or polymer, with adaptations as necessary to serve as weight bearing foundation walls. The attainment of these and other objectives will become apparent in the description that follows.

SUMMARY OF THE INVENTION

According to one aspect of the invention, a perimeter foundation wall is constructed from modular wall panels with flat exterior wall surfaces. The panels are preferably made of steel, but could be made of a polymer. The individual panels have a generally planar shape with a flange formed on each vertically extending side by bending the side edges at a right angle in the same direction. These side flanges have matching bolt holes to allow another panel to be joined to it on either side to form a vertical wall. The panels are also bent at the top and base into the same direction to the panel as the side flanges to form a top cap and base pan, as described more fully in the detailed description.

In basement foundations in which the perimeter wall, including one or more beams across the wall, is the primary support, the flat panels described above are reinforced by vertical reinforcement members or framing studs spaced at regular intervals (e.g. at 16 inch centers on a 48 inch wide panel) and by vertical support brackets along the seams where adjacent panels are bolted together. The top caps of the panels, supported by the framing studs, provide a base for a sill plate. The base pans of the panels provide an anchor to be encapsulated in a concrete footer or slab floor. A shorter and less wide beam support post may be installed between adjacent normal size wall panels to form a beam pocket in which to seat a beam extending across the foundation to a similar beam pocket located on an opposite side of the perimeter wall. A modular stair well may also be placed between adjacent wall panels to form a basement walkout or egress. Windows, doors and egress windows may be formed in above grade sections of the wall.

The same wall panels can also be used for an above ground perimeter wall that acts primarily as a perimeter tie-down and seal around a building having an interior pier support foundation. They could be used as described in the background of the invention, that is, merely installed with lag screws through the top caps into the building sill plate and hung under the perimeter with the bottom end embedded in a concrete-filled trench. In such installations, the framing studs and brackets may not be needed or may be used sparingly, since the vertical load will be much less than the full weight of the building. However, the panels can also be used to create a more load supporting foundation wall by raising a staked guide board or string line properly leveled to the height of the interior support piers, hanging wall panels with framing studs and support brackets from it, and pouring the concrete footer to encapsulate the base pans of the panels to secure the panels as a foundation wall before lowering the manufactured building onto the foundation wall and piers.

Whether used as a primary support wall or as a perimeter tie-down, it is convenient to have an easy way to raise the wall panels to desired height and level the top of the wall before pouring an encapsulating concrete footer or slab floor. In this aspect, the wall panel assemblies include leveling devices for adjusting and supporting the panels at a desired level height. The preferred leveling support devices are rods with external threads on at least a portion of the rod, attached to a load bearing plate at the lower end of the rod. The rods extend through the base pan of the wall panels and a pair of internally threaded nuts on the support rods above and below the base pan are used to adjust and lock to support the panels at a desired height above the bearing plate. The leveling assemblies permit the upper edge of a perimeter wall foundation to be leveled without the need for a perfectly level footing or trench at the base.

Preferably the leveling devices also include a bracket located at the junction between two wall panels such that the bracket contacts each of the adjoining panels. The bracket has a bottom plate located between the base pan of the panels and the lower of the pair of adjustment nuts. The bracket has elongated slots receiving the threaded rods from each of the adjoining panels.

In another aspect of the leveling assembly, the base of the wall panel is connected to one or more expansion box frames having the threaded rods passing though the box and through the base pan of the panel. The sides of the box frame fit into each other and slide vertically. A pinch clip on the sides allows the box to be fixed together after the rod is set to the proper height by crimping the clips. Concrete poured into the footer trench and/or slab flows into and fills the box cavity and the base pan, encapsulating the rods and providing even support for the wall.

The wall panel assemblies described above may also be used to form the perimeter wall of a pier support foundation for a manufactured house. According to one exemplary method of using the panels, a footing trench is excavated at a site where the perimeter foundation will be located. The wall panels are then assembled by securing the panels side to side (e.g., by nut and bolt fasteners received in aligned openings in the side flanges of the panels). The panels are supported at a desired height above the bottom of the footing trench by adjusting the location of the nuts on the support rods. With the panels positioned at the desired height, concrete is poured into the trench to a sufficient depth to encase the leveling support assemblies and the bases of the panels within the concrete. The panel assembly of the perimeter foundation can be secured to the house by bolts received though the top caps of the panels into a sill plate of the house. The panels can be vented with holes placed at above ground locations.

The panels can be reinforced for increased load bearing by vertical studs extending between the base pan and the top cap and spaced at even intervals in the interior of the panels, and by vertical reinforcement brackets along both sides of the seam where adjoining panels are bolted together.

DESCRIPTION OF THE INVENTION

Figure 1:
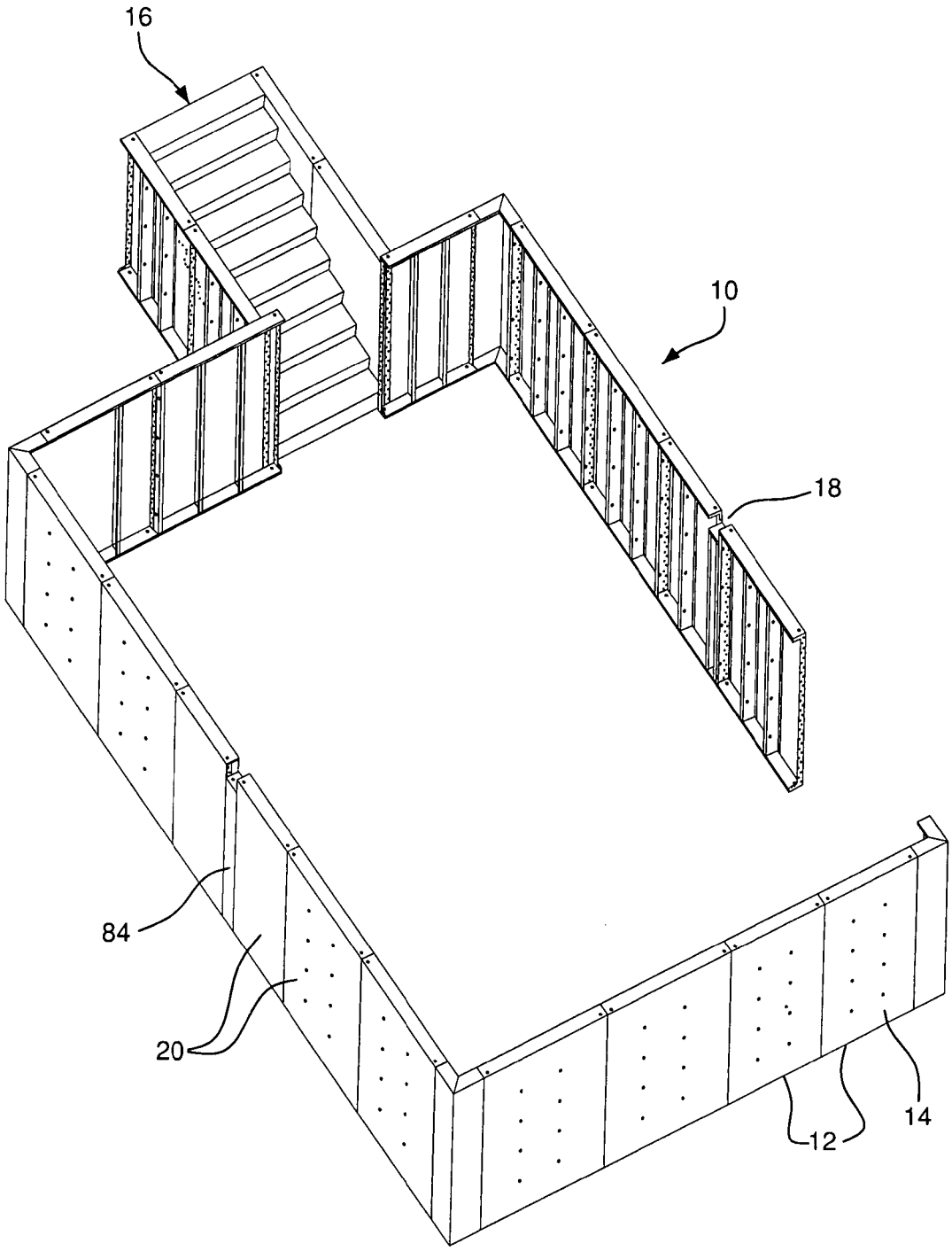
FIG. 1 is a top front perspective view of a basement wall constructed from wall panels having a generally flat exterior face in which the basement perimeter wall provides the main support for the building foundation, coupled with a cross beam pocket.
Figure 2:
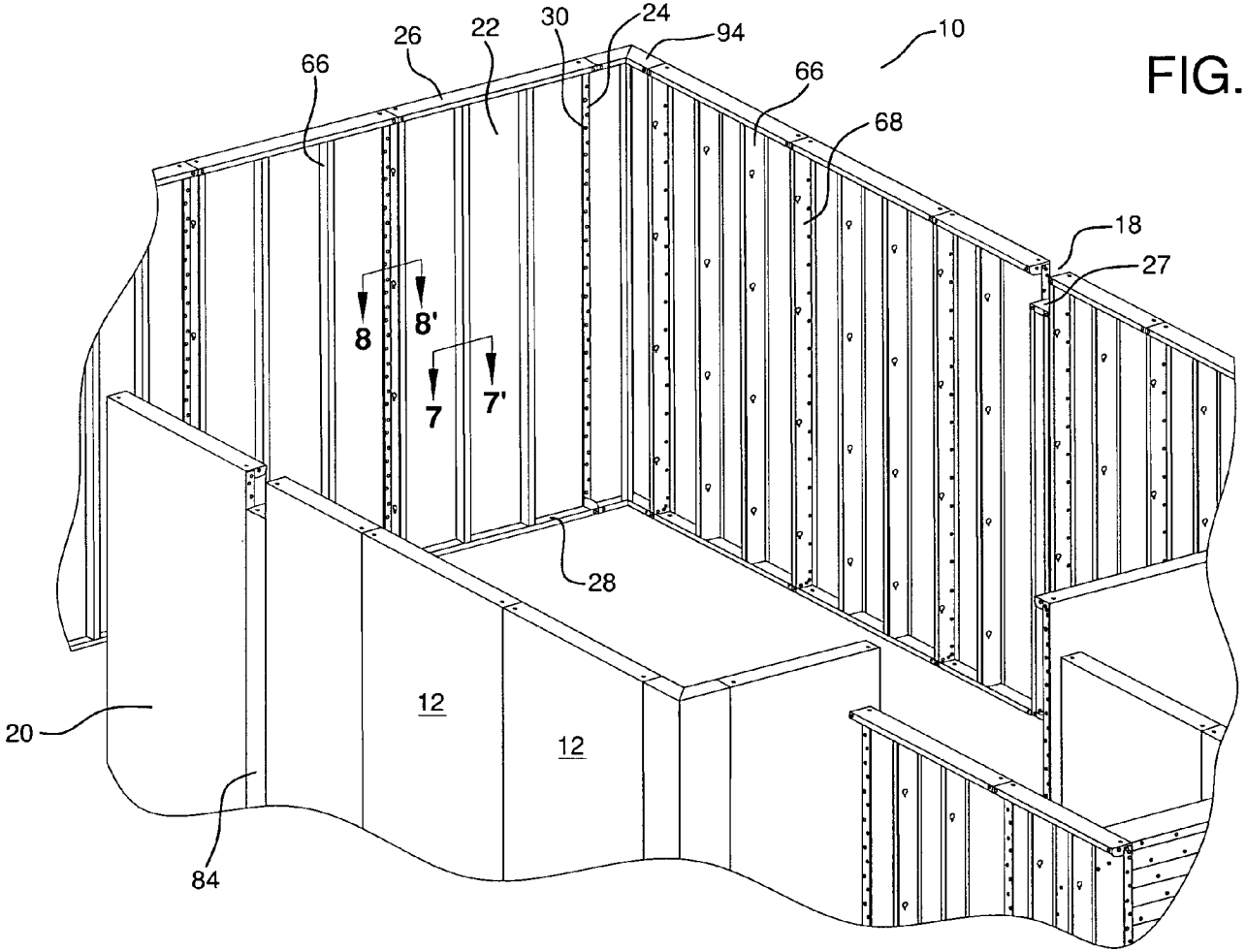
FIG. 2 is a view of a section of two walls from the interior of the basement area of FIG. 1.
Figure 3:
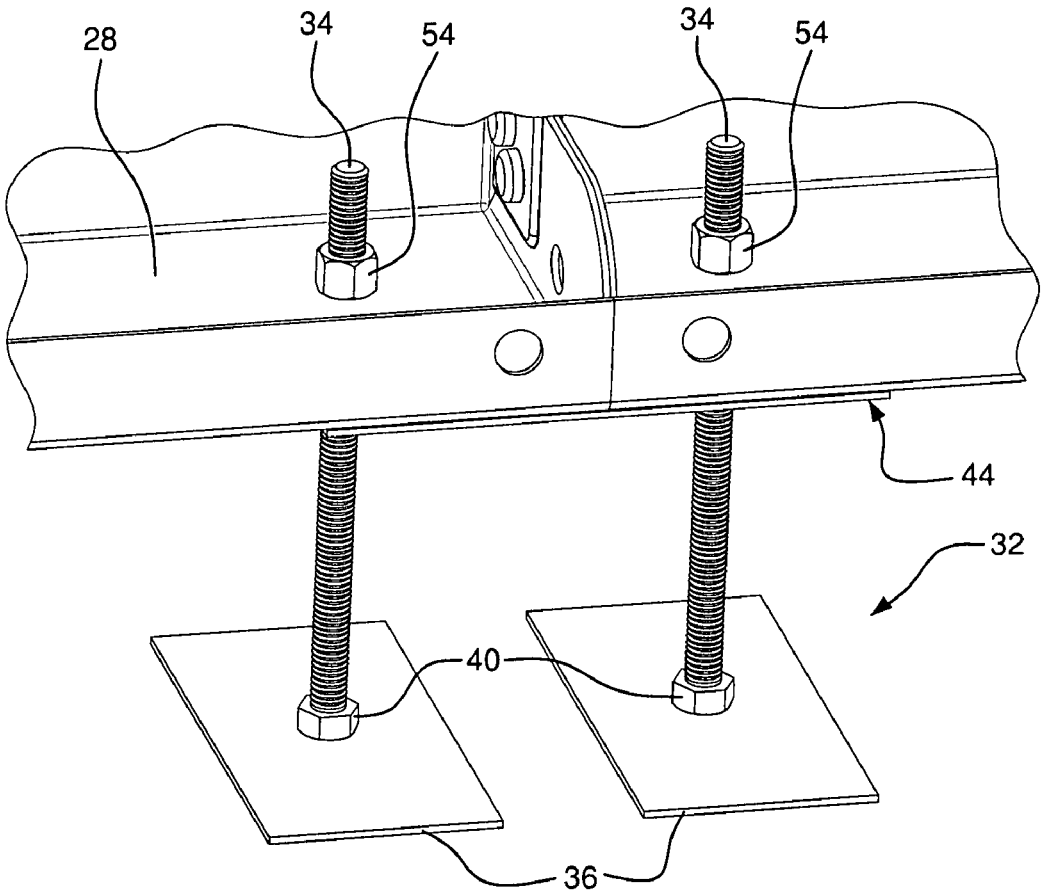
FIG. 3 is a view of the bottom portion of two adjacent wall panels of the wall in FIG. 1 showing an assembly of leveler devices which may be used to raise, lower and level the top of the perimeter wall.

Referring to the drawings, where like numerals identify like elements, FIGS. 1 and 2 illustrate an in-ground basement foundation where the basement perimeter wall is the primary foundation for a building. This foundation may include on or more cross beam supported in two opposite beam pockets of the wall. Attached to the wall is a steel staircase forming a basement walkout. This figure will be used to identify the elements of a foundation constructed from wall panels having a generally flat exterior face. The same wall panels having a generally flat exterior face can be used to make a wall used primarily for perimeter tie-down and closure of the area under a structure supported by interior pier supports.

As shown in FIGS. 1 and 2, the foundation wall 10 is formed primarily from preformed structural wall panels 12, preferably made from steel that is galvanized or otherwise weather coated. Each of the panels 12 includes an upstanding wall portion 14 that is substantially flat or planar on its outside surface (outside flatness may have minor irregularities such as the stubs of mechanical fasteners such as toggle locks or rivets used to attach vertical reinforcing studs on the interior side, as described below). Attached to the wall 10 is a steel stair well 16 with steps to provide a walkout exit. The wall 10 also includes two opposite beam pockets 18 to accommodate a cross wall support beam. A longer wall could have more than one cross beam.

The structural wall panels 12 have a generally flat outside surface 20 (although the panels can be curved for customized buildings where the foundation is not rectangular and yet retain a flat outside surface). The inside surface of the panels have a generally flat portion 22 in the interior, but is bent at the edges. A panel 12 has a side flange 24 on each vertically extending side bent at a right angle in the same direction. The wall panel 12 also is bent at the top edge to from a top cap 26, and at the bottom edge to form a base pan 28, extending in the same direction as the side flanges. The side flanges have bolt holes 30 at set intervals to allow two panels to be joined together by bolts and nuts.

An exemplary wall panel 12 may be made of galvanized or other coated 14 gauge steel. The outer wall surface 20 dimension may be 48 inches width and of varying height, depending upon whether the wall is being constructed for a perimeter tie down or for a basement shear wall. For example, a perimeter wall enclosing an interior pier support foundation may be as low as 3 to 4 feet in height, while a deep basement wall could require wall panel height of 10 feet or more.

As shown in FIGS. 3 through 6, the wall panels may include leveling support assemblies 32. Without leveling supports, the uniformity of the structural wall panels can only keep the top ledge of the wall as level as the surface on which the bottom of the panels rest. Hence, if adequate care is taken to pour and carefully level a perimeter footer on which to place the wall panels, further leveling may not be needed. In many situations, however, the outline of the perimeter wall will merely be made as a shallow trench inside the major excavation pit for the foundation. The trench may be filled with aggregate stone until the basement's concrete floor is poured. Alternatively, a shallow concrete footer may be made in the pit following the intended outline of the perimeter wall, with only a rough attempt to level the surface of the footer. The leveling support assemblies 32 allow adjustments for varying the height at which the panels 12 are supported above the stone surface or concrete footer.

Further, when a perimeter wall is used primarily as an above grade enclosure wall, with interior support piers carrying the primary load, the wall panel may merely be extended into a shallow dirt trench. In such situations, the adjustment feature eliminates the need for precision in leveling the bottom of the trench that would otherwise be required.

Figure 4:
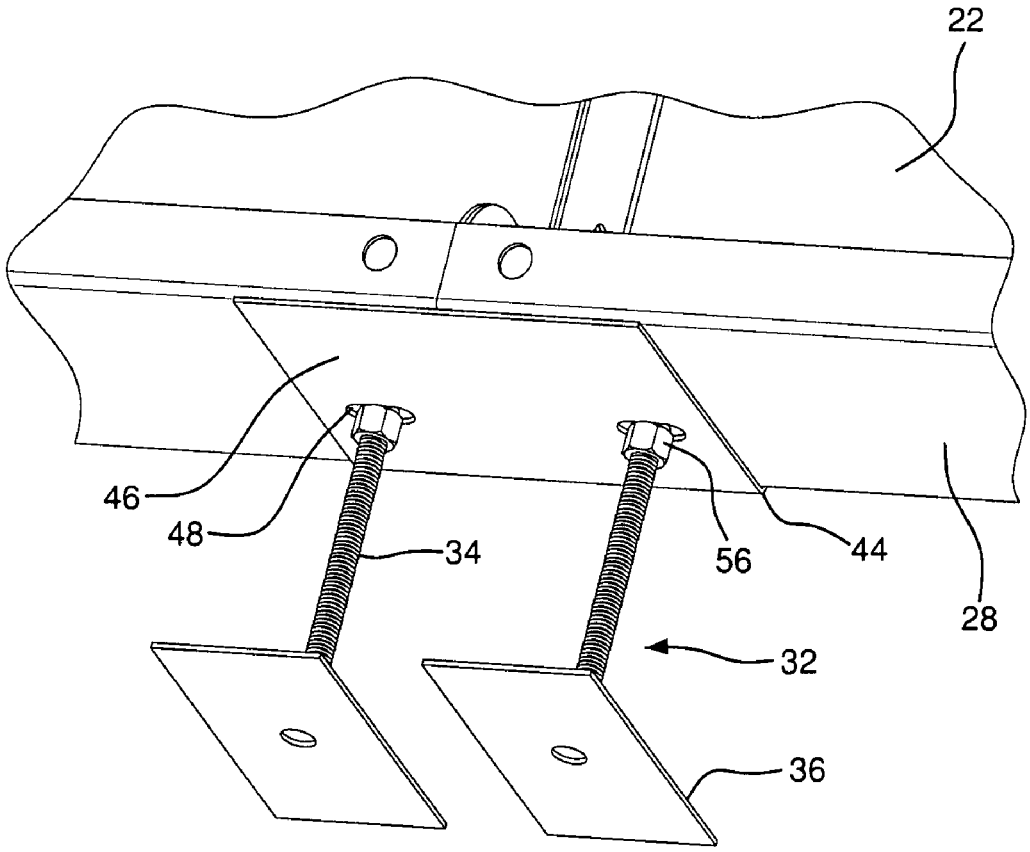
FIG. 4 is a bottom front perspective view of the wall panels and leveler assembly of FIG. 3.
Figure 5:
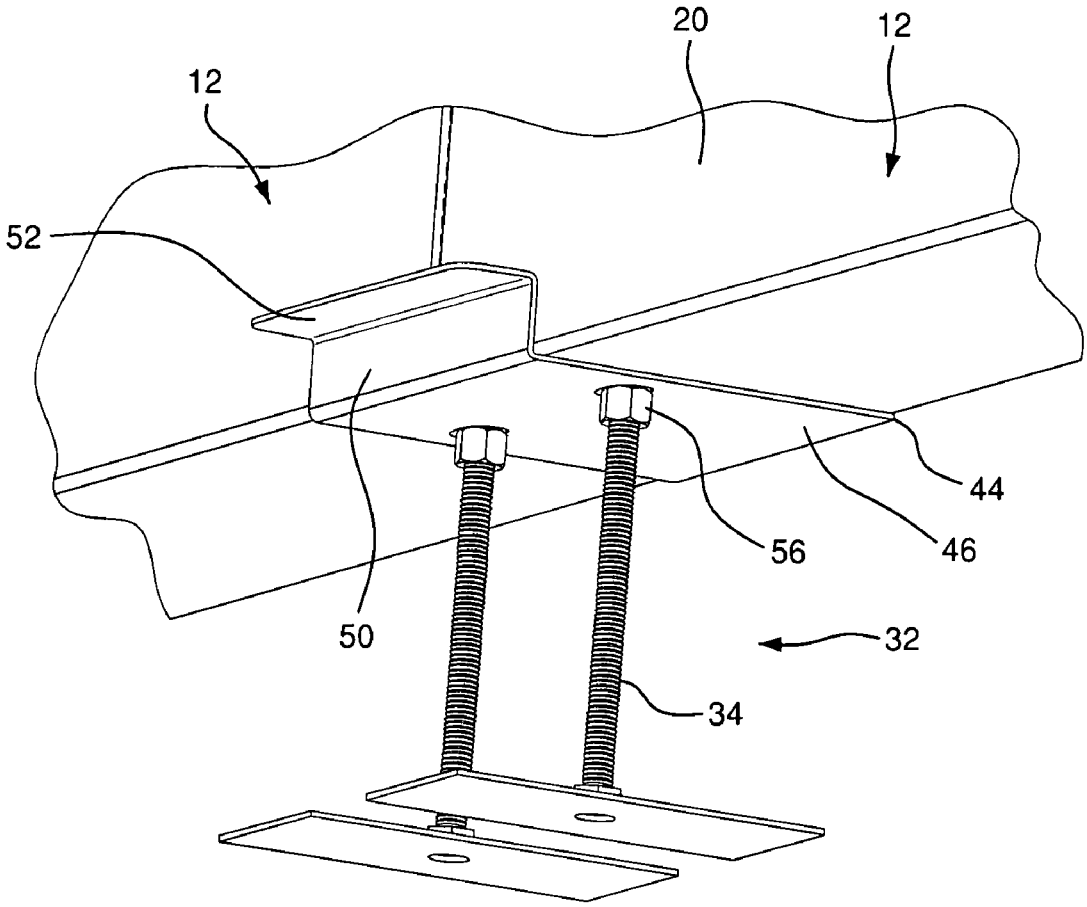
FIG. 5 is a bottom rear perspective view of the wall panels and leveler assembly of FIG. 3.

The preferred leveling support assembly 32 includes a pair of elongated threaded rods 34 and a bearing plate 36 attached to the lower end of the rod 34. Referring to FIG. 4, the bearing plate 36 includes an opening 38 for receiving the end of the rod 34. An internally threaded nut 40 is preferably received on the lower end of the rod. The nut 40 couples load from the rod 34 to the bearing plate 36 and prevents the rod from being driven downwardly through the opening 40.

The end of the rod 34 opposite the bearing plate 36 is received through an opening (not shown) in the base pan 28 of the associated wall panel 12. The openings are located near the wall panel sides where adjacent panels are joined. A bracket 44 located under the seam between panels (unction between two adjoining panels) contacts and supports both of the panels 12. The bracket 44 includes a bottom band 46 with elongated slots 48 to pass through the two threaded rods. The elongated slots 48 allow for some transverse adjustment in the relative position of the bracket with respect to the two adjacent wall panels. The bracket 44 also includes an upstanding wall portion 50 extending substantially perpendicular to the bracket's bottom band 40 along the outside walls of the adjoining panels 12. A flange 52 extends outwardly from an upper end of the upstanding wall portion 50. This flange may serve as a fixed point to assist in the leveling process.

A pair of nuts 54 and 56 are located on the threaded rod 34 above and below the base pan 28 and bracket 44. The location of the upper and lower nuts 34, 36 along the threaded rod 26 can be adjusted by rotating the nut members 34, 36 with respect to the rod 26 thereby raising or lowering the associated panels above their respective bearing plates. The lower nut 34 is the height adjusting nut, while the upper nut 34 is used to clamp the height adjustment once it is made. These adjustments at the panel seams thereby adjust the height of the top edge of the wall panels for purposes of leveling.

Once the wall panels have been secured to each other and the leveling support assemblies 22 have been adjusted as described above to support the panels 12 at the desired height above the support location and the walls are vertically plumbed, the entire leveling support structure can be sealed by pouring a concrete footer or concrete slab floor to a level where the concrete fills the base pan of the panels.

Figure 6:
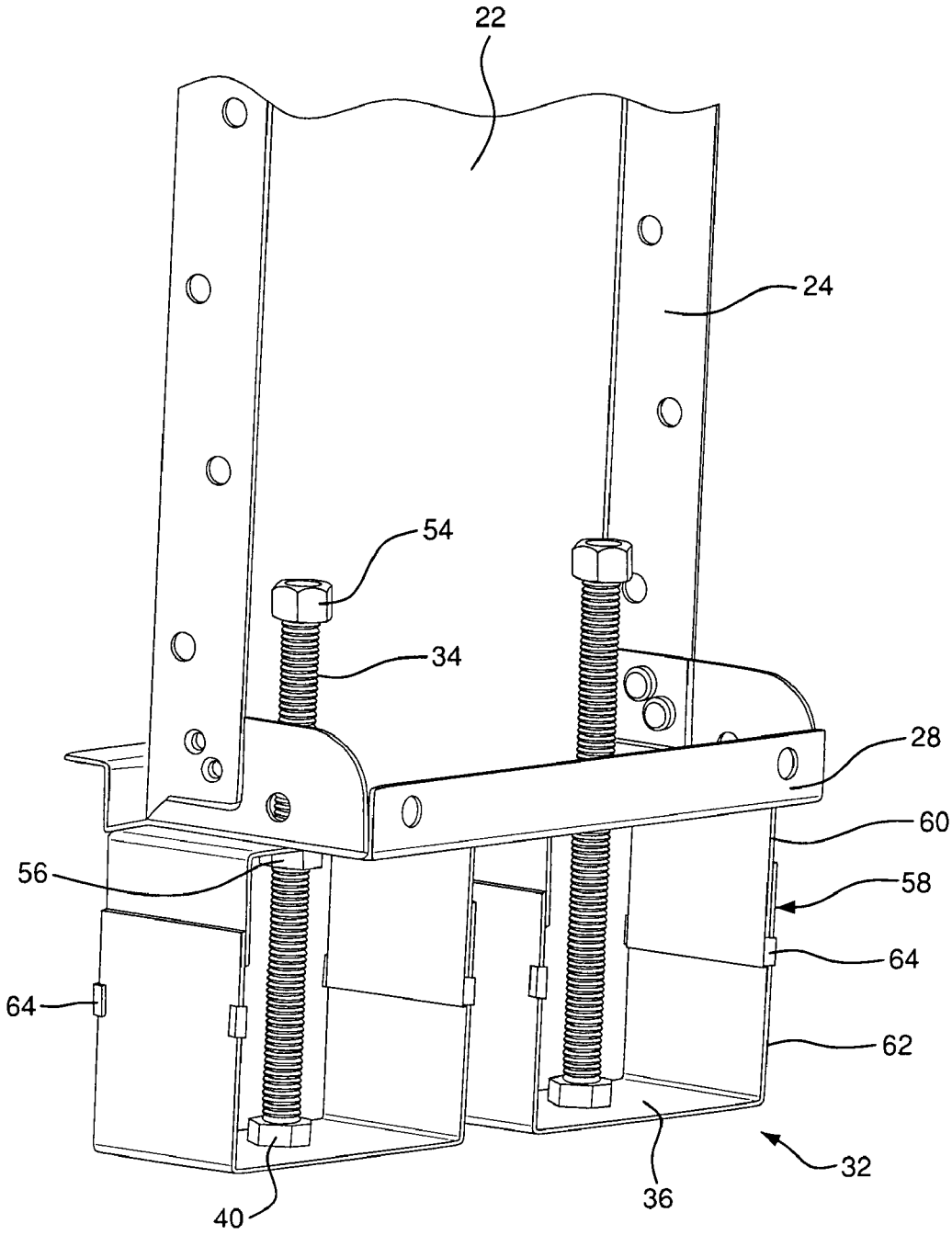
FIG. 6 is a side quarter view of the bottom of two adjacent wall panels of FIG. 1 showing an alternative leveler assembly using a telescoping box frame around the threaded leveler rods.

An alternative embodiment shown in FIG. 6 adds a telescoping box frame 58 around each threaded rod. The box frame 58 is two channels 60, 62, top and bottom, with one (preferably top 60) being slightly shorter in length than the other, but otherwise having about the same width and same side wall heights. The shorter top channel 60 is placed inside and on top of the longer channel 62. The bottom channel 62 becomes the bearing plate 36 and includes an opening 38 for receiving the end of the rod 34. The top channel includes slots 48 to pass through two threaded rods. After the wall height is adjusted with the nuts, the two channels can also be fixed in position by crimping side clips 64 on the adjacent edges. Again, once all of the walls have been secured to each other and the nut members 34, 36 of the leveling support assembly 22 have been adjusted to level and the walls are vertically plumbed, a concrete footer or concrete slab floor can be poured filling box frame and the base pans of the wall panels.

Depending upon how much load the perimeter wall be subjected to, the wall panels wall panels may require additional structure to resist bending. When the perimeter wall 10 is the main support structure of the foundation, as in the basement wall embodiment of FIGS. 1 and 2, the wall panels may require substantial additional structure to resist bending under the vertical and side loads.

Figure 7:
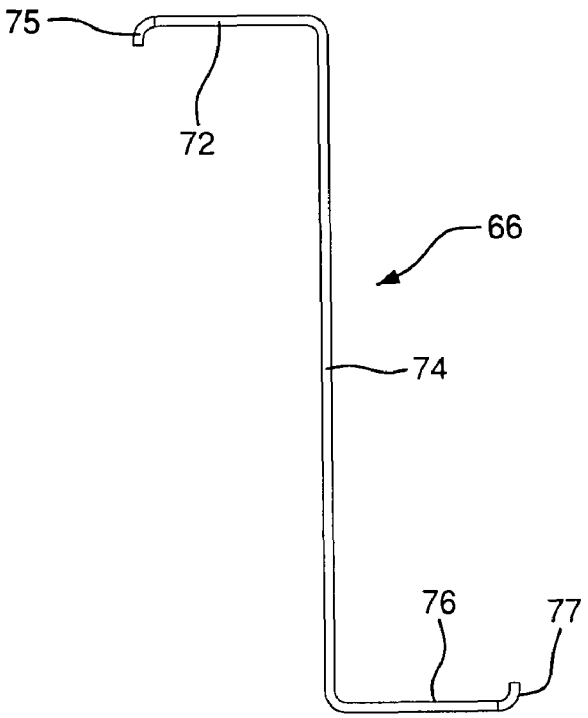
FIG. 7 is a section view of a vertical reinforcing stud taken along the line 7-7 in FIG. 2.

Vertical reinforcement members or framing studs 66 spaced at regular intervals (i.e., at 16 inch centers on a 48 inch wide panel) and by vertical support brackets 68 along the seams 70 where adjacent panels are bolted together provide such resistance. Vertical reinforcement members (or framing studs) 66 are preferably 14 gauge coated steel channels having a roughly Z cross'section as shown in FIG. 7. One flange 72 is fastened against the flat portion 22 on the inside of the wall panel. The web 74 of the stud 66 extends inwardly perpendicular to the plane of the wall then is bent at a right angle to form a second flange 76 in the direction opposite the first flange 72. One or both flanges may terminate with a short reflected edge 75, 77 that extends parallel to the web 74. The spacing of the vertical reinforcement studs can be matched to the expected load. For example, in the basement wall shown in shown in FIGS. 1 and 2, the studs can be placed at 8 inch, 12 inch or 16 inch centers depending upon the expected vertical and side loading. The studs 66 may have cutouts to allow passage of electrical conduit or plumbing.

Figure 8:
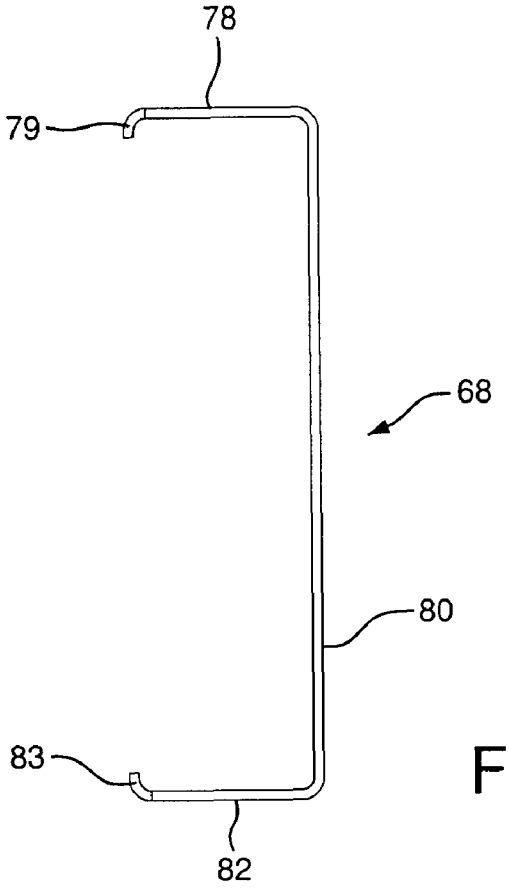
FIG. 8 is a section view of a vertical edge reinforcing bracket taken along the line 8-8 in FIG. 2

Vertical support brackets 68 are used to stiffen the wall panel connection between adjacent panels and to increase vertical support. A support bracket is preferably C-shaped in cross section as shown in FIG. 8. One flange 78 extends against the flat portion 22 on the inside of the wall panel. The web 80 of the bracket 66 extends inwardly perpendicular to the plane of the wall then is bent at a right angle to form a second flange 82 in the direction opposite the first flange 78. One or both flanges may terminate with a short reflected edge 79, 81 that extends parallel to the web 74. The web 80 has bolt holes arranged to align with the bolt holes in the side flanges of the wall panels. A bracket 68 can be attached to the wall flanges on one or both sides of a panel connection. The brackets 68 may have cutouts to allow passage of electrical conduit or plumbing.

The corners of the foundation wall may be formed of corner pieces 94. The corner pieces can form a right angle corner as shown in FIG. 1, or be curved corners of various radii. The corner pieces have side flanges like the wall panels and have bolt holes aligned with those in the wall panels. The corner pieces also have a top cap and base pan like the wall panels.

Figure 9:
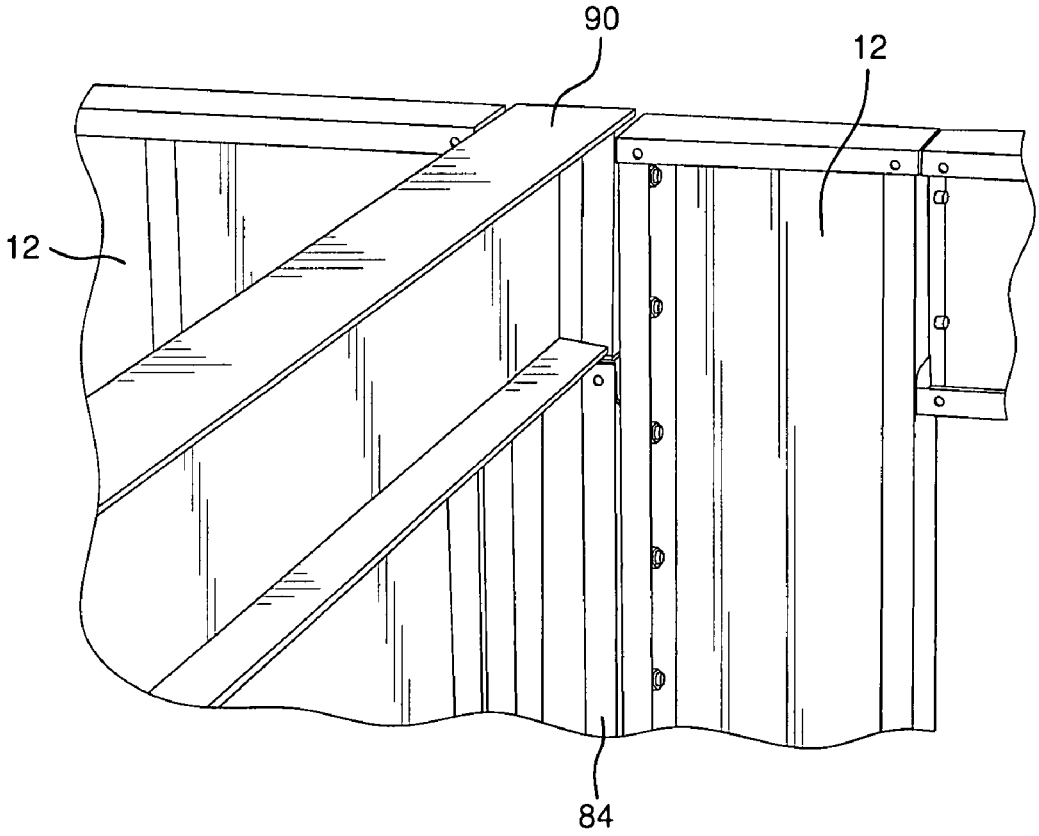
FIG. 9 is a view of a portion of a wall having a cross beam installed in the beam pocket.
Figure 10:
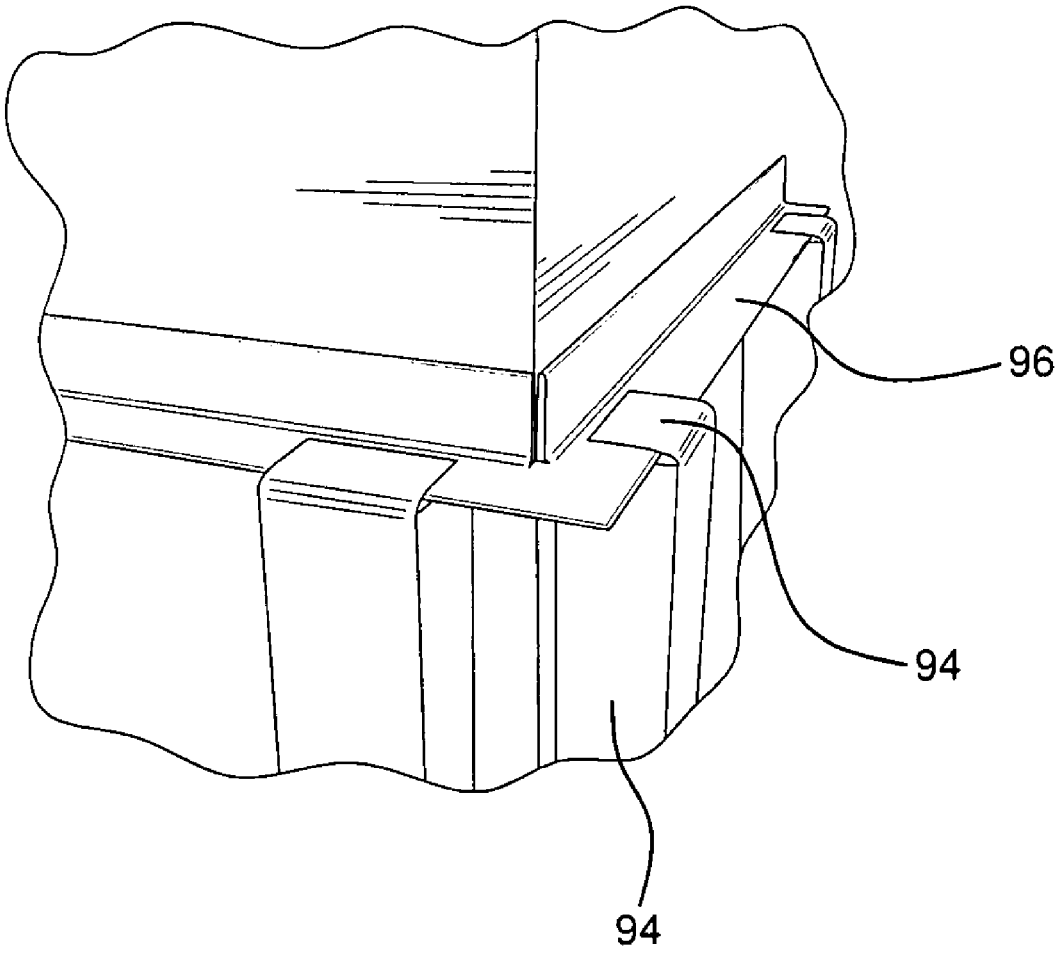
FIG. 10 is a view of a facing support shelf formed on the outside of a foundation wall.

As shown in FIGS. 1, 2 and 9, a beam pocket 18 may be placed in the perimeter wall by placing a beam post 84 between two wall panels 12. The beam post is essentially the same configuration as a wall panel, except that it is shorter than the height of the wall panel by about the height of a standard steel I-beam 90, and is about the width of the beam's flanges, so that the I-beam sits conformingly in the beam pocket 18 formed between the two higher panels on each side. The sides of the beam post are reinforced by bolting a support bracket 68 onto each side flange. The top cap 27 of the beam post may be covered by a plate. The beam 90 may be fixed in the pocket by bolts extending through the cap 27 and though holes drilled in the beam.

A conventional sill plate may be placed around the top caps of the wall panels and corner panels and over the beam. Floor joists are then placed across the walls transverse to the beam. To assist in locating and installing the floor joists, a joist anchor can be mounted on the sill plate. The joist anchor is an elongated 90 degree angle bracket formed from sheet steel of suitable thickness, such as 14 gauge. The sheet is cut to dimension and bent to a right angle at the bottom to form (a) a short bottom flange having a width that is less than the width of the sill plate that will be laid on the foundation wall, and (b) an upright flange having a height to make it approximately flush with the top of a floor joist placed in the anchor resting on the bottom flange. Holes may be drilled or stamped in the bottom flange to pass through anchor bolts extending from the foundation wall panels and cross beam though the sill plate. Holes may also be provided in the upright flange for screws attaching the end of the floor joist to the anchor, or the screws can self-drill these holes. Since the short bottom flange of the sill plate has a width that is less than the width of the sill plate, there is room behind the joist anchor to fit a trim board to cover the heads of the screws.

The above described panel elements can be used to form a perimeter foundation for a structure in a variety of applications of which the following are non-limiting examples.

Example 1

Pier Support with Perimeter Foundation Wall (Single Set)

A manufactured house is set on support piers. A footing trench is then dug about the entire perimeter of the house to accommodate the wall panels. A perimeter wall is then assembled by securing the flat surfaced wall panels 12 to each other (i.e., bolting the panels together at adjacent side flanges) . The upper and lower nuts 40,42 of the leveling support assemblies 32 are then adjusted along the elongated rods 34 to raise the panels 12 from the bearing plate 36 in the trench bottom into contact with the bottom sill of the manufactured house. The panels 12 may secured to the house structure by lag bolts driven through the top cap 26 of the wall panels into the wood sill plate of the house. Concrete is then poured into the footing trench such that the leveling support assemblies 32 and the base pan 28 of the panels 12 are encased within the concrete. The wall panels may include vertical reinforcement members or framing studs spaced at regular intervals and/or vertical support brackets along the seams where adjacent panels are bolted together.

Example 2

Pier Support with Perimeter Foundation Wall (Double Set)

This method is used to establish a more level foundation than the single set method, since the sill plate may sag in places when the full weight house is placed on the piers. Leveling before the house is permanently set eliminates the sag. A manufactured house is lowered temporarily onto interior piers to establish a height of the sill plate above ground. The height is then marked around the perimeter. A footing trench is then created under house about the entire perimeter of the house to a regulated depth and width to accommodate the wall panels 12. The perimeter wall is then assembled in a free standing manner by bolting the panels 12 together and raising the panels to the marked level height using the leveling support assemblies 32 and plumb guides. Concrete is then placed into the trench to form a perimeter foundation such that the leveling support assemblies 32 and the base pans 28 of the panels are encased in the concrete. After the concrete has cured sufficiently to bear load, the house is then relowered onto the perimeter foundation and attached using lag bolts into its sill plate as above. The wall panels may include vertical reinforcement members or framing studs spaced at regular intervals and/or vertical support brackets along the seams where adjacent panels are bolted together Example 3

Basement Foundation

This is essentially the foundation shown in FIGS. 1 and 2. A pit is excavated to sufficient dimensions to accommodate the planned basement and allow working space around the exterior of the basement walls and a walkout stairwell from the basement. The bottom of the pit is covered with a leveled layer of aggregate stone. Preferably, a low concrete footer is created that will follow the outline of the basement walls and stairwell walls, provide a smooth surface of about 8-12 inches (increased to three times the wall width under any cross beam posts) on which to erect and anchor the wall panels and stairwell.

If a steel stairwell 16 is used, it is set in place and anchored first on the respective portion of the footer. The wall panels 12 are then assembled. If vertical support studs 66 are being used, they can be fastened onto the wall panels at the proper spacing before the panels are connected together. If leveling assemblies 32 are being used, the bearing plates 36, rods 34 and nuts 40, 54 and 56, and leveler brackets 44 are installed at the slots 18 in the base pans at each (and box frames 58 if they are used).

The wall panels 12 can then be connected. Starting from the sides of the stair well 14, the panels are bolted together, with support brackets 68 on at least one side of the joined seams. When the section for the beam post 86 is reached, the post is installed with a support bracket 68 inside the post 86 on both sides. If desired, a synthetic rubber strip, such as a butyl adhesive tape or caulk, may be used between the seam of the adjacent panel connections.

When the wall sections are in place, the top of the perimeter wall can then be leveled using the leveling assemblies as necessary and vertically plumbed. A basement floor can then be poured and set, allowing the concrete to fill around the levelers and over into the base pans, encapsulating the bottom of the wall in concrete.

The cross beam is then set into the beam pocket 86. The beam 90 may be fixed in the pocket by bolts extending through the cap and though holes drilled through the beam. A sill plate for the structure is then attached along the top surface of the panels. Construction of the building lower floor structure is then continued by attaching floor joists and floor decking.

The outside surface of the wall structure is preferably sealed by caulking the seams and spraying a urethane sealing layer on the entire exterior wall before the pit is backfilled. The exterior surface may also be prepared for supporting a decorative facade. Support stakes 94 may be attached to the wall to support a ledge or shelf 96 mounted on the stakes 94 at a height that will be below grade when the pit is back filled. The ledge can be used to support decorative facing, such as a brick stone facade. Other exterior surfaces visible above ground can be painted or covered with mesh and stucco or other decorative finish before or after backfilling the pit.

We claim:

1. A perimeter foundation wall constructed from a plurality of modular wall panels, the wall panels comprising:

a generally planar exterior wall surface;

two side flanges including a side flange on each vertical side of a panel, the side flanges each being bent at a right angle to extend in the same direction from the exterior wall surface, each side flange have matching bolt holes to allow a similar panel to be joined to it on either side to form a wall;

a top cap formed from a top edge of the exterior wall surface bent to extend in the same right angle direction from the exterior wall surface as the side flanges;

a base pan formed from a bottom edge of the exterior wall surface bent to extend in the same right angle direction from the exterior wall surface as the side flanges and the top cap;

vertical reinforcing brackets attached to at least one of adjacent side flanges and extending from the base an to the top cap along a seam where two coplanar panels are fastened together;

one or more vertical reinforcing studs attached to an inner surface of each of the wall panels at regular spacing between the side flanges of each wall panel and extending from the base an to the top cap; and a leveling assembly associated with the base pan, the leveling assembly including two threaded rods, each rod passing through the base an of a panel near the side flanges of the panel to a support plate beneath the panel, and each rod having at least one height adjustment nut and an open expanding box frame around each rod.

2. A perimeter foundation wall constructed from a plurality of modular wall panels, the wall panels comprising:

a generally planar exterior wall surface;

two side flanges including a side flange on each vertical side of a panel, the side flanges each being bent at a right angle to extend in the same direction from the exterior wall surface, each side flange have matching bolt holes to allow a similar panel to be joined to it on either side to form a wall, a top cap formed from a top edge of the exterior wall surface being bent to extend in the same right angle direction from the exterior wall surface as the side flanges;

a base pan formed from a bottom edge of the exterior wall surface being bent to extend in the same right angle direction from the exterior wall surface as the side flanges and the top cap; and a pair of beam support pockets, each support pocket formed by a beam post disposed between two wall panels wherein the beam post has an exterior surface, two side flanges each bent to extend at a right angle in the same direction away from the exterior surface, each side flange have matching bolt holes to allow the beam post to be joined to a panel on either side, a top cap bent to extend in the same right angle direction from the exterior surface as the side flanges, and a base pan bent to extend in the same right angle direction from the exterior surface as the side flanges and the top cap, the beam post being shorter than the height of the wall panel by about the height of a standard steel I-beam, and about the width of the I-beam's flanges, so that the I-beam can be seated conformingly in the pocket formed above the beam post and between the wall panels.

3. A foundation wall as in claim 2, further comprising a stair well having two vertically extending sides, with side flanges on both vertically extending sides having bolt holes matching the holes in the side flanges of the wall panels.

* * * * *